United States Patent [19]

Richter

[11] 4,117,254

[45] Sep. 26, 1978

[54] DEVICE FOR PASSING ELECTRIC CURRENT THROUGH A WALL SUBJECTED TO EXCESS PRESSURE ON ITS INNER SIDE

[76] Inventor: Artur Richter, 25 Langensiepenstrasse, Mulheim, Ruhr, Germany

[21] Appl. No.: 747,088

[22] Filed: Dec. 3, 1976

[30] Foreign Application Priority Data

Dec. 16, 1975 [DE] Fed. Rep. of Germany ..... 2556546

[51] Int. Cl.[2] ..... H01B 17/26

[52] U.S. Cl. ..... 174/15 BH; 174/18; 174/153 R

[58] Field of Search ..... 174/15 BH, 16 BH, 18, 174/152 R, 152 E, 153 R; 55/146

[56] References Cited

U.S. PATENT DOCUMENTS

| | | | |
|---|---|---|---|
| 2,028,942 | 1/1936 | Money | 174/153 R |
| 2,219,613 | 10/1940 | Berghaus et al. | 174/15 BH |
| 3,179,859 | 4/1965 | Ray et al. | 174/153 R X |
| 3,213,685 | 10/1965 | Mannherz et al. | 174/153 R X |

FOREIGN PATENT DOCUMENTS

| | | | |
|---|---|---|---|
| 1,412,345 | 8/1965 | France | 174/153 R |
| 1,932,323 | 1/1970 | Fed. Rep. of Germany | 174/15 BH |

*Primary Examiner*—Laramie E. Askin
*Attorney, Agent, or Firm*—Remy J. VanOphem

[57] ABSTRACT

A device for passing an electric current through a wall subjected to excess pressure on its inner side, and comprising: a sleeve received in an aperture in the wall, which sleeve is integrally formed at its inner end with a collar engaging the inner surface of the wall; an electrical conductor for passing said electric current, which conductor includes a shaft passing through the sleeve, a head on the inner end of said shaft, and an inclined, e.g. conical, surface on said head tape-ring towards said shaft; a recess at the inner end of said sleeve; an opposing surface in said recess facing said inclined surface on the head of the conductor; an outer insulator including a hollow cylindrical portion engaging between the outer end of the sleeve and the aperture in the wall; a seal, such as an O-ring seal, between the hollow cylindrical portion and the sleeve; and axially operating clamping means carried by the outer end of the shaft, which clamping means act on the outer end of the sleeve, and on said outer insulator, to compress the sleeve between said clamping means and said head on the inner end of the shaft.

7 Claims, 1 Drawing Figure

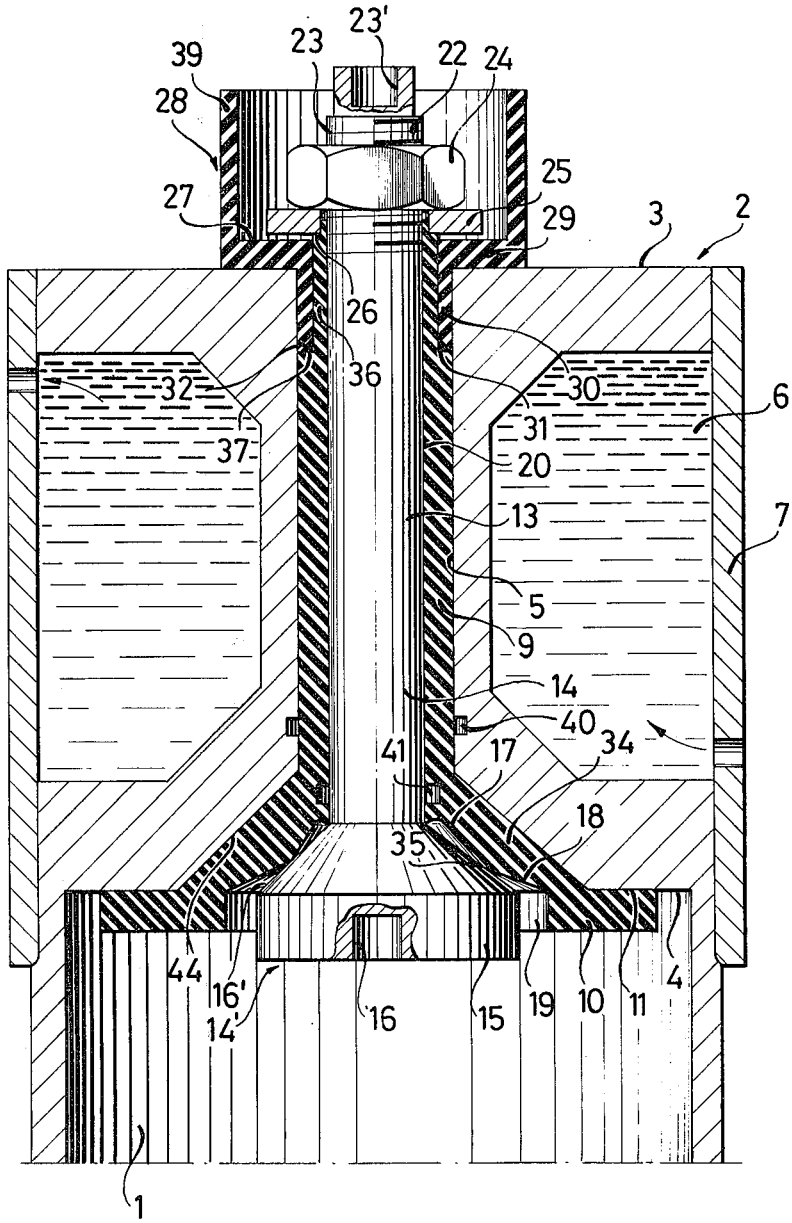
23'
23
22
24
39
28
25
27
29
3
2
26
36
32
30
6
37
31
20
13
7
5
9
14
40
34
41
17
18
35
44
16'
14'
16
15
19
10
11
4
1

DEVICE FOR PASSING ELECTRIC CURRENT THROUGH A WALL SUBJECTED TO EXCESS PRESSURE ON ITS INNER SIDE

BACKGROUND OF THE INVENTION

The invention relates to a device for passing electric current through a wall subjected to excess pressure on its inner side, in particular the wall of a pressure gasifier for coal. In a known type of device the wall is formed with an aperture which accepts a sleeve through which a conductor passes, which sleeve is braced against the inner side of the wall by an integral collar.

One of the chief areas of application of the invention is in the conducting of current to dust arrester installations, known as electro-filters, of pressure gasifiers for coal. If these electro-filters are arranged before the gas scrubber, they are subjected to relatively high temperatures, for example, around 600° C. The temperature is higher than when the electro-filters are arranged after the gas scrubber, although even in this case high temperatures still prevail. Also, coal pressure gasifiers operate at pressures of the order of 20 atmospheres. A device for passing electric current through a wall of an electro-filter is thus subjected to pressures and temperatures of this scale, and is additionally mechanically stressed in the wall by forces transmitted through the current supply cable.

The above-mentioned known type of device usually has a sleeve consisting of ceramic material which directly encloses the electrical conductor and has the job of preventing voltage flashovers. This device is only suitable, however, for relatively low pressure of around 1 atmosphere and is thus not suitable for use in pressure gasifiers for coal. It also has numerous other disadvantages.

On heating, stresses are produced in the material of the sleeve due to the differing coefficients of thermal expansion, which stresses are still further increased by the pressure difference and cannot be dispersed in the material. Moreover, because of its low impact strength, ceramic material is only serviceable for use in a high pressure system under certain conditions. Also, no possibilities for repair exist for a damaged insulation, and the device has to be completely removed and sent to the manufacturer when damaged. The known device is additionally susceptible to shock and strain and thus can only absorb low mechanical forces transmitted through the cable.

The known device also cannot be used under high pressure because, amongst other things, on breakage of the collar the entire device flies out of the aperture in the wall and a rapid pressure drop ensues, which is unacceptable. Moreover, the ceramic mass tends to form hairline cracks which can lead to indifferent operation.

The result of these disadvantages is that hitherto it has not been possible to use electro-filters reliably in coal pressure gasification processes, and for this reason no suitable cleaning of the gasification gas could be provided directly before or after the gas scrubbers.

The essential task of the invention is to provide a device of the type referred to in the introduction which can withstand the combined stresses of pressure differential, heat expansion, and the forces mechanically exerted by the cable.

SUMMARY OF THE INVENTION

According to the invention there is provided a device for passing an electric current through a wall subjected to excess pressure on its inner side and comprising a sleeve to be received in an aperture in the wall, which sleeve is integrally formed at its inner end with a collar adapted to engage the inner surface of the wall; an electrical conductor for passing said electric current, which conductor includes a shaft passing through the sleeve, a head on the inner end of said shaft, and an inclined surface on said head tapering towards said shaft; a recess at the inner end of said sleeve; an opposing surface in said recess facing said inclined surface on the head of the conductor; an outer insulator including a hollow cylindrical portion for engagement between the outer end of the sleeve and the aperture in the wall; a seal engaged by said hollow cylindrical portion; and axially operating clamping means carried by the outer end of the shaft, which clamping means act on the outer end of the sleeve, and on said outer insulator, to compress the sleeve between said clamping means and said head on the inner end of the shaft.

The sleeve preferably consists of a relatively elastic insulating material and on installation is first deformed by the forces generated by the axially acting clamping means, whereupon the outer insulator receives necessary contact pressure. The increased elasticity also makes possible the dispersion of the stresses which arise from the pressure and temperature conditions during operation. This capability of the material is so high that it can absorb the strains transmitted by the cable, without losing the required sealing.

A device according to the invention has numerous advantages. Not only can the device withstand the mechanical stresses which arise and which are transmitted by the electric cable, and is independent of the changing stress conditions due to the operational conditions prevailing; it also ensures a considerable protection against the injection of the conductor if the sleeve, or its collar, is destroyed. Furthermore, if such considerable sealing pressures are applied that the overall size of the device is reduced, the device according to the invention can be tightened up during operation. Finally, a device according to the invention will continue to provide the required protection against voltage flashovers on tightening-up of the device to achieve a sealing of the system.

According to a further characteristic of the invention, the inner end of the wall aperture is given an inwardly-facing inclined surface and the sleeve includes a neck portion forming a transition from the outer surface of the sleeve to said collar, which inclined surface is adapted for engagement with said inwardly-facing surface of the wall aperture. On tightening the sleeve by the clamping means, the inclined surface of the neck of the sleeve is driven against the inclined surface of the wall aperture and cooperates with that surface over a considerable area which provides the necessary sealing.

A further improvement is achieved if, according to another characteristic of the invention, said opposing surface in said recess at the inner end of the sleeve comprises two conical surface portions of differing inclinations meeting at an inwardly directed common edge. This shape, a similar effect to which may also be achieved by doming the opposing surface, produces good sealing on first tightening an extending lineal contact or conductor shaft as a result of the forces arising during tightening against a surface contact with very high specific area pressures.

According to a further characteristic of the invention, the cross-sectional dimension of the head of the conductor is greater than the external cross-sectional dimension of said sleeve (and hence of the wall aperture).

This is the prerequisite for, in the event of a complete destruction of the sleeve, the head not being able to be forced through the wall aperture.

In a preferred embodiment of the invention the outer end of the sleeve has an external reduced-diameter portion engaged by said hollow cylindrical portion of the outer insulator, said seal being disposed between said hollow cylindrical portion and the sleeve. The outer insulator should prevent a voltage flash-over in this area of the conductor and thus includes, according to a preferred embodiment of the invention, a flange which extends radially outwardly from said hollow cylindrical portion so as, in use, to engage the outer surface of said wall, and a hollow cylinder joined to said flange and enclosing the aforesaid clamping means. This arrangement of the exterior insulator increases the spark gap presupposed by the operational voltage and makes possible the use of higher voltages. Furthermore, the hollow cylinder can receive a filling of insulating material.

The operational safety of the device according to the invention as well as the freedom of choice of materials can be considerably increased if, in accordance with another characteristic of the invention, cooling is provided in the wall, namely in the region surrounding its aperture.

BRIEF DESCRIPTION OF THE DRAWING

The following is a more detailed description of a preferred embodiment of the invention, reference being made to the accompanying drawing in which the single FIGURE is a longitudinal section of a device according to the invention, the electric cable and a possible casting of the exterior insulation are omitted.

DESCRIPTION OF THE PREFERRED EMBODIMENT

Referring to the FIGURE, there is shown a recess 1 which is connected to the pressure chamber of a coal pressure gasifier. The recess is provided in order to remove the electrical conductor from the direct action of the hot flowing gases which emerge from the gasifier as gasification gas. Adjacent the recess 1 is a wall, indicated generally at 2. The exterior surface 3 of the wall is under normal pressure. The interior surface 4 is under the pressure of the electro-filter which, for example, can amount to 20 atmospheres. According to the embodiment illustrated, the wall 2 has an aperture 5 which is surrounded by a cooling chamber 6. In the chamber 6, which is closed with the aid of a separating metal sheet 7, flows a cooling medium, e.g. water. This is because of the considerable temperatures prevailing on the inner side of the wall and which can amount to about 500° C.

The aperture 5 is cylindrical. For this reason the parts described in the following are formed rotationally symmetrically, which, however, for the practical realisation of the invention is not absolutely essential.

The aperture 5 receives a sleeve 9 which is integrally formed with a collar 10 on the inner side of the wall 2, the underside 11 of the collar engaging the inner surface 4 of the wall.

The sleeve surrounds an electrical conductor 13. This conductor has a shaft 14. The end of the shaft at the inner side of the wall 2 is formed with a head 14'. This head has a cylindrical end 15 with a cable connection which is shown schematically at 16. Also the head 14' has, as a result of the rotational symmetry, a conical formed transition surface 16' joining the cylindrical end 15 to the shaft 14. Corresponding conical surfaces 17 and 18 respectively are provided in a recess 19 at that end of the sleeve 9 which is formed with the collar 10.

The conductor 13 is located in the central cylindrical passage 20 through the sleeve 9.

A cable connection 23', not shown in detail, is located at the end 22 of the shaft 14 of the conductor 13 opposite to the head 14'. This end is also provided with an external thread 23. A nut provided with surfaces for a key, e.g. a hexagon-headed nut 24, can be screwed on this external thread, which nut acts on a washer 25. The end of the sleeve 9 is reduced in diameter to provide an annular shoulder 26 on which the washer 25 sits.

The parts 22 to 25 together form a clamping or tensioning device which acts on the outer sleeve end at 26 and which, after a certain tightening movement, leads to the washer 25 seating on the outer surface 27 of an external insulator, indicated generally at 28. On continued tightening of the nut 24 the necessary pressure can be applied for the sealing of the outer insulator 28.

The outer insulator has an annular flange 29 which sits on the external surface 3 of the wall 2 and joins, at its inner periphery, the outer end of a hollow cylindrical section 30. At the other end of the hollow cylindrical section 30 there is formed a conical surface 31. This conical surface is braced against an O-ring 32.

The outer end of the sleeve 9 has a portion 36 which is reduced in diameter. This provides an annular shoulder 37 on which the O-ring 32 rests. The hollow cylindrical section 30 of the insulator 28 is located between the reduced-diameter portion 36 and the inner surface of the aperture 5.

The outer periphery of the flange 29 of the outer insulator 28 joins one end of a hollow cylinder 39 which encloses the clamping device and a part of the cable connection. The hollow cylinder 39 can be filled with a liquid insulating material.

The sleeve 9 consists of an elastic electrically insulating material.

The aforementioned conical surfaces 17 and 18 are formed in a neck portion 34 of the sleeve 9 which forms the transition from the shaft of the sleeve to the collar 10. The conical surfaces 17 and 18 are of different incination so that a limiting edge is produced which protrudes inwardly.

The diameter of the head 14' of the conductor 13 is selected to be greater than the diameter of the aperture 5 in the wall. Thus, even if the sleeve is destroyed, the conductor can not be hurled out by reason of the excess pressure on its inner side.

After the parts have been arranged as shown in the drawing, the nut 24 is first turned on the thread 23 so as to move towards the wall 2. This applies to the washer 25 pressure which first deforms the end of the portion 36 and exerts axial forces which draw the conical surface 16' of the head 14' into engagement with the opposing conical surfaces 17, 18, on the sleeve 9. This has the effect of axially shortening the sleeve 9 and expanding it laterally. This causes a considerable sealing pressure between the sleeve and the conductor 13 and the inner surface of the aperture 5, because the sleeve material is displaced elastically.

Finally, on further tightening of the nut 24 the washer 25 reaches the flange 27 and presses this against the exterior surface 3 of the wall 2. Simultaneously the O-ring seal 32 is also put under pressure which prevents leaks. If required, further O-ring seals can be inserted at 40 and 41 in order to enhance the sealing effect.

The tightening of the nut 24 can be adjusted whilst the device is operating.

In the embodiment illustrated the aperture 5 in the wall 2 is formed at its inner end with a conical surface 44 converging inwards, which is contacted by a conically shaped surface of the neck 34. From this results also the shape of the cooling chamber 6 as shown in the drawing. The direction of flow of the coolant is shown by arrows.

I claim:

1. A device for passing an electric current through a wall subjected to excess pressure on its inner side, and comprising: a sleeve received in an aperture in the wall, which sleeve is integrally formed at its inner end with a collar adapted to engage the inner surface of the wall; an electrical conductor for passing said electric current, which conductor includes a shaft passing through the sleeve, a head on the inner end of said shaft, and an inclined surface on said head tapering towards said shaft; a recess at the inner end of said sleeve; an opposing surface in said recess facing said inclined surface on the head of the conductor, said opposing surface comprising two conical surface portions of differing inclinations meeting at an inwardly directed common edge, which edge is in contact with said inclined surface on said head; an outer insulator including a hollow cylindrical portion for engagement between the outer end of the sleeve and the aperture in the wall, the outer end of the sleeve having an externally reduced diameter portion engaged by said hollow cylindrical portion of the outer insulator; a seal disposed between said hollow cylindrical portion and the sleeve; axially operating clamping means carried by the outer end of the shaft, which clamping means acts on the outer end of the sleeve, and on said outer insulator, to compress the sleeve between said clamping means and said head on the inner end of the shaft to expand said sleeve laterally into abutment with the wall of said aperture, and to compress said seal between said hollow cylindrical portion and said sleeve.

2. A device according to claim 1 wherein said inclined surface on the head of the conductor is conical.

3. A device according to claim 1 wherein the cross-sectional dimension of the head of the conductor is greater than the external cross-sectional dimension of said sleeve.

4. A device according to claim 1 wherein the outer insulator includes a flange extending radially outwardly from said hollow cylindrical portion so as, in use, to engage the outer surface of said wall, and a hollow cylinder joined to said flange and enclosing the aforesaid clamping means.

5. A device according to claim 4 wherein the outer end of the sleeve protrudes into the hollow cylinder.

6. A device according to claim 1 wherein the sleeve includes a neck portion having an inclined surface forming a transition from the outer surface of the sleeve to said collar, which inclined surface is adapted for engagement with a corresponding inwardly-facing inclined surface formed in the inner surface of the wall having the aperture receiving the sleeve.

7. A device according to claim 1, wherein the wall portion is formed with a cooling chamber which surrounds the aperture in the wall portion and is adapted to receive a fluid coolant.

* * * * *

UNITED STATES PATENT AND TRADEMARK OFFICE

CERTIFICATE OF CORRECTION

PATENT NO. : 4,117,254

DATED : September 26, 1978

INVENTOR(S) : Artur Richter

It is certified that error appears in the above-identified patent and that said Letters Patent are hereby corrected as shown below:

Column 2, line 40, delete "injection" and insert ----ejection----.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*